US010464077B2

(12) United States Patent
Lin et al.

(10) Patent No.: US 10,464,077 B2
(45) **Date of Patent: *Nov. 5, 2019**

(54) COMBINATION SHOWERHEAD WITH SWING BUTTON SWITCHING

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Fujian (CN); Mingfu Zhang, Fujian (CN); Jincan Zhang, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/334,907

(22) Filed: Oct. 26, 2016

(65) Prior Publication Data

US 2017/0165682 A1 Jun. 15, 2017

(30) Foreign Application Priority Data

Dec. 11, 2015 (CN) ..... 2015 1 0917298

(51) Int. Cl.
*B05B 1/16* (2006.01)
*B05B 1/18* (2006.01)
(Continued)

(52) U.S. Cl.
CPC ..... *B05B 1/1636* (2013.01); *B05B 1/18* (2013.01); *B05B 12/002* (2013.01); *E03C 1/0408* (2013.01); *B05B 1/1627* (2013.01)

(58) Field of Classification Search
CPC ... B05B 1/1627; B05B 1/1636; B05B 1/1681; B05B 1/18; B05B 1/185; E03C 1/0408
See application file for complete search history.

(56) References Cited

U.S. PATENT DOCUMENTS 6,032,877 A * 3/2000 Kagan ..... B05B 1/1636 239/446
7,043,776 B1 * 5/2006 Wu ..... E03C 1/0408 4/601

(Continued)

FOREIGN PATENT DOCUMENTS

CN 103521369 A 1/2014

*Primary Examiner* — Alexander M Valvis
(74) *Attorney, Agent, or Firm* — Rabin & Berdo, P.C.

(57) ABSTRACT

A combination showerhead with swing button switching includes a fixing holder mounted to a supporting arm and including an inlet passage connected to the supporting arm and at least two diversion passages; a first showerhead mounted to the fixing holder and connected to at least one of the at least two diversion passages; a second showerhead connected to another of the at least two diversion passages; and a switching mechanism including a diversion plate rotatable relative to the fixing holder and cooperating with the inlet passage and the at least two diversion passages to switch waterways; a transmission part fixed on the diversion plate; and a swing button that is swingable relative to the fixing holder and that is connected to the transmission part so that swinging of the swing button drives the transmission part and causes the diversion plate to rotate. The fixing holder further includes a fixing seat.

11 Claims, 9 Drawing Sheets

(51) Int. Cl.
*B05B 12/00* (2018.01)
*E03C 1/04* (2006.01)

(56) References Cited

U.S. PATENT DOCUMENTS

| | | | | |
|---|---|---|---|---|
| 8,720,799 | B2 * | 5/2014 | Tseng | E03C 1/06 239/282 |
| 8,919,379 | B2 * | 12/2014 | Zhou | B05B 1/1618 137/625.48 |
| 2013/0247294 | A1 * | 9/2013 | Zhou | B05B 1/1636 4/615 |
| 2014/0054398 | A1 * | 2/2014 | Lev | B05B 1/185 239/443 |
| 2015/0360243 | A1 * | 12/2015 | Soetaert | B05B 1/18 4/615 |
| 2017/0165684 | A1 * | 6/2017 | Lin | B05B 1/1627 |
| 2017/0165685 | A1 * | 6/2017 | Lin | B05B 1/1627 |
| 2017/0165686 | A1 * | 6/2017 | Lin | B05B 1/18 |
| 2017/0167121 | A1 * | 6/2017 | Lin | B05B 1/185 |
| 2017/0173603 | A1 * | 6/2017 | Lin | B05B 1/1663 |

* cited by examiner

COMBINATION SHOWERHEAD WITH SWING BUTTON SWITCHING

FIELD OF THE INVENTION

The present invention relates to combination showerhead, and especially to a combination showerhead with swing button switching.

BACKGROUND OF THE INVENTION

The existing combination showerhead, as Chinese patent No. 103521369A disclosed, is a shower system comprising a top-spray showerhead with at least two spray types and a handle showerhead, and the top-spray showerhead is disposed with an inlet passage for water supply and first diversion passages corresponding to spray types; the top-spray showerhead is disposed with a second diversion passage connected to the handle showerhead by a hose; a switching mechanism disposed on the top-spray showerhead is capable of switching waterway by cooperating with the inlet, first passages and second passages, thereby any of the diversion passage could be selected to connect with the inlet, however, the structure is not compact enough and needs further improvement.

SUMMARY OF THE INVENTION

The objective of present invention is to provide combination showerhead with swing button switching, which overcome the disadvantages of the existing technology.

The technical proposal of the present invention is that:

A combination showerhead with swing button switching comprises: a fixing holder (10) mounted to supporting arm, a first showerhead (20) mounted to the fixing holder (10), a second showerhead (30) and a switching mechanism (40), the fixing holder (10) comprises an inlet passage (11) connected to the supporting arm and at least two diversion passages (12) of which one is connected to the second showerhead (30) and others are connected to the first showerhead (20);

wherein the switching mechanism (40) comprises:

a diversion plate (41), which is capable of rotating relative to the fixing holder (10) and cooperated with the inlet passage (11) and the diversion passages (12) to switching waterway;

an eccentric component (42) fixed on the diversion plate (41); and a swing button (43), which is capable of swinging relative to the fixing holder (10) and being connected to the eccentric component (42) in transmission way, and swinging of the swing button (43) drives the diversion plate (41) to rotate through transmission of the eccentric component (42) and the swing button (43).

In one preferred embodiment, a connecting plate (431) is fixed on back of the swing button (43), and end of the connecting plate (431) is concavely disposed with a slide groove (432), the eccentric component (42) is connected in the slide groove (432) and capable of moving along the slide groove (432), with cooperation of the slide groove (432) and the eccentric component (42), swinging of the swing button (43) drives the diversion plate (41) to rotate.

In another preferred embodiment, the switching mechanism (40) further comprises an elastomer (44) abuts against between the diversion plate (41) and the fixing holder (10).

In another preferred embodiment, the fixing holder (10) comprises a diversion body (132) which has a fitting surface (555), and the fitting surface (555) is concavely disposed with diversion holes corresponding to diversion passages (12) one to one; the diversion plate (41) sealingly abuts against the fitting surface (555) to realize switching of the diversion holes by rotating; an assembly hole (135) is disposed throughout the upside and downside of the diversion body (132), the transmission part (4) or eccentric component (42) is fixed on a surface of the diversion plate (41) facing to the fitting surface (555), the eccentric component (42) pass through the assembly hole (135) and the swing button (43) is connected on the part of the eccentric component (42) passing through the assembly hole in transmission way.

In another preferred embodiment, back of the fixing holder (10) is convexly disposed with an assembly portion (13) and the switching mechanism (40) is disposed inside the assembly portion (13) with at least part of the swing button (43) locates outside for user's operation.

In another preferred embodiment, the second showerhead (30) is handle showerhead; the outlet of the diversion passages (12) connected to the second showerhead (30) is disposed on the sidewall of the assembly portion (13), and the handle showerhead is connected to corresponding outlet through a flexible hose (50), front lower part of the fixing holder (10) is disposed with a connecting portion (14) for handle showerhead positioning.

In another preferred embodiment, the second showerhead (30) is fixed showerhead fixed on the front lower part of the fixing holder (10).

In another preferred embodiment, the fixing holder (10) has a common portion (15) and two forking portion (16) forking extend from the common portion (15), the first showerhead (20) is rotatably connected between the two forking portion (16); a hose piece (21) is disposed along the rotation axis of the first showerhead (20) and part of the diversion passage (12) is connected to the first showerhead (20) along the hose piece (21).

In another preferred embodiment, the assembly portion (13) is disposed on back of the common portion (15).

In another preferred embodiment, the first showerhead (20) is capable of being rotatably connected to the fixing holder (10), and a damping mechanism (60) is disposed between the fixing holder (10) and the first showerhead (20).

In another preferred embodiment, the damping mechanism (60) comprises a locating holder (61), a turning block (62) and a cam (63), at least two dangling pieces (64) disposed separately in circumferential direction on the locating holder (61) form a rotary sleeve-like structure with at least part of the inner wall being of radii changing, the cam (63) is disposed in the rotary sleeve to match the radii changing part, the turning block (62) is sleeved on the rotary sleeve, friction force of the dangling pieces (64) and the turning block (62) changes with rotation of the cam (63) relative to the radii changing part and thereby the damping changes.

In another preferred embodiment, the fixing holder (10) has a common portion (15) and the first showerhead (20) is rotatably connected to the common portion (15); at least a hose piece (21) is disposed along the rotation axis of the first showerhead (20) and part of the diversion passage (12) is connected to the first showerhead (20) along the hose piece (21).

Comparing to the existing technology, the present invention has advantages as follows:

1. The switching mechanism is disposed on fixing holder; the first showerhead could be new design or existing one; the swinging of swing button drives diversion plate to rotate through swing button and eccentric component's transmission, thereby the switching is realized; for one thing, the switching with swing button driving is novel and convenient for one-handed operation, for another, transmission is realized by cooperation of swing button and eccentric component, which is of reasonable layout, compact and simple structure.

2. Swinging of swing button drives diversion plate to rotate with cooperation of slide groove and eccentric component, transmission through cooperation of swing button and slide groove is stable and the structure is simple and compact.

3. Eccentric component is fixed on a surface of diversion plate facing to the fitting surface, eccentric component pass through assembly hole and swing button is connected on the part of eccentric component passing through assembly hole in transmission way, which is of reasonable layout, compact structure and easy assembly.

4. Back of fixing holder is convexly disposed with assembly portion and switching mechanism is disposed inside assembly portion, part of swing button locates outside, which is of reasonable layout, compact structure, good-looking appearance and easy operation.

5. A connecting portion for handle showerhead positioning is disposed on the front lower part of the fixing holder, which facilitates user to take down or lay up with good-looking appearance.

6. The fixing holder has common portion and forking portions, the first showerhead is rotatably connected between the two forking portions; since the first showerhead is rotatable, user can adjust the angle of water flowing according to needs, which is convenient.

7. Damping mechanism is disposed between forking portion of fixing holder and the first showerhead so that the first showerhead could be positioned in a certain angle.

8. With rotation of the cam relative to the radii changing part, friction force of the dangling pieces and the turning block changes and thereby the damping changes, which is of simple and compact structure and easy to use.

BRIEF DESCRIPTION OF THE DRAWINGS

The present invention will be further described with the drawings and the embodiments.

DETAILED DESCRIPTION OF THE EMBODIMENTS

Figure 1:
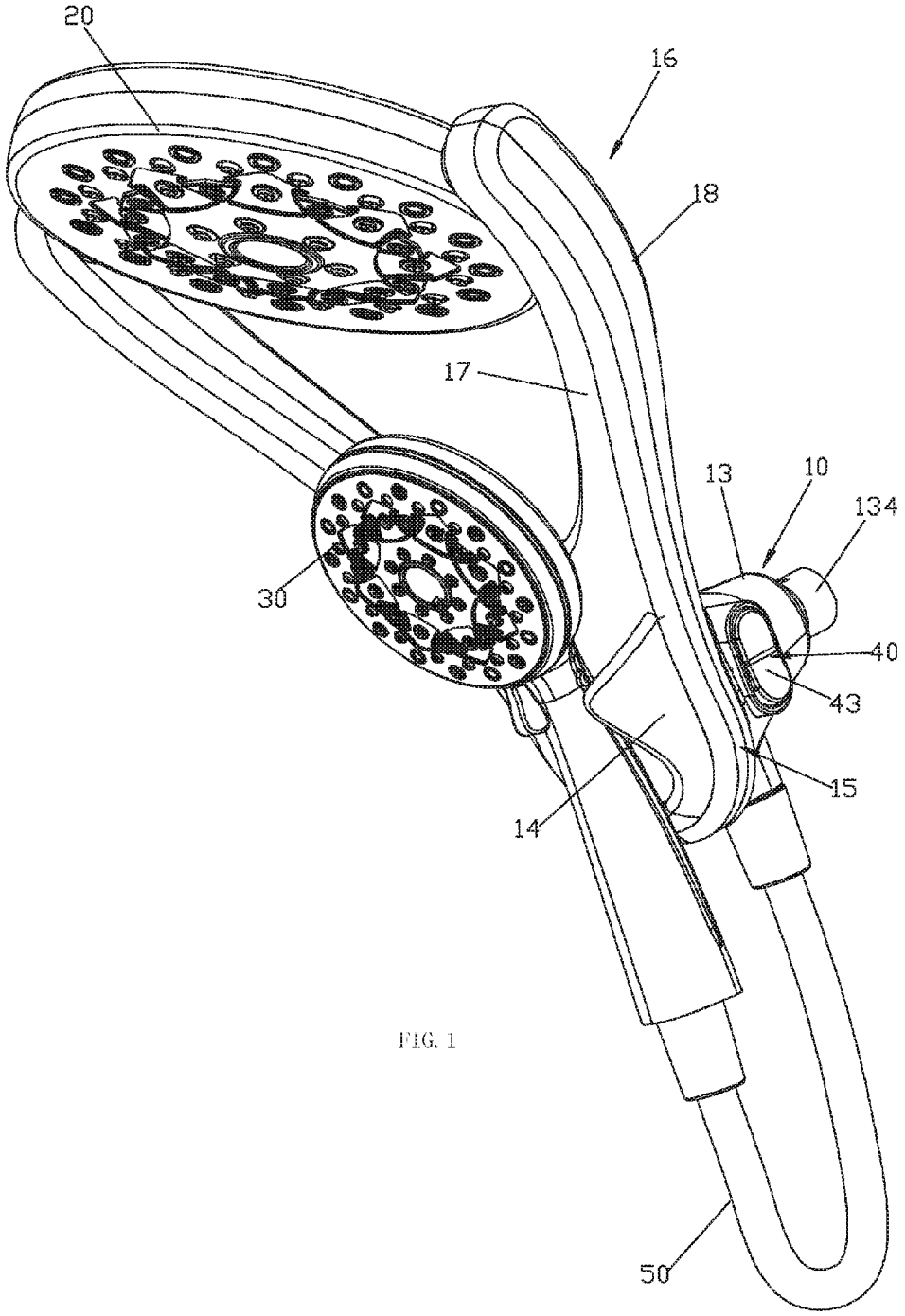
FIG. 1 illustrates a perspective schematic diagram of the combination showerhead of a preferred embodiment.
Figures 2, 3:
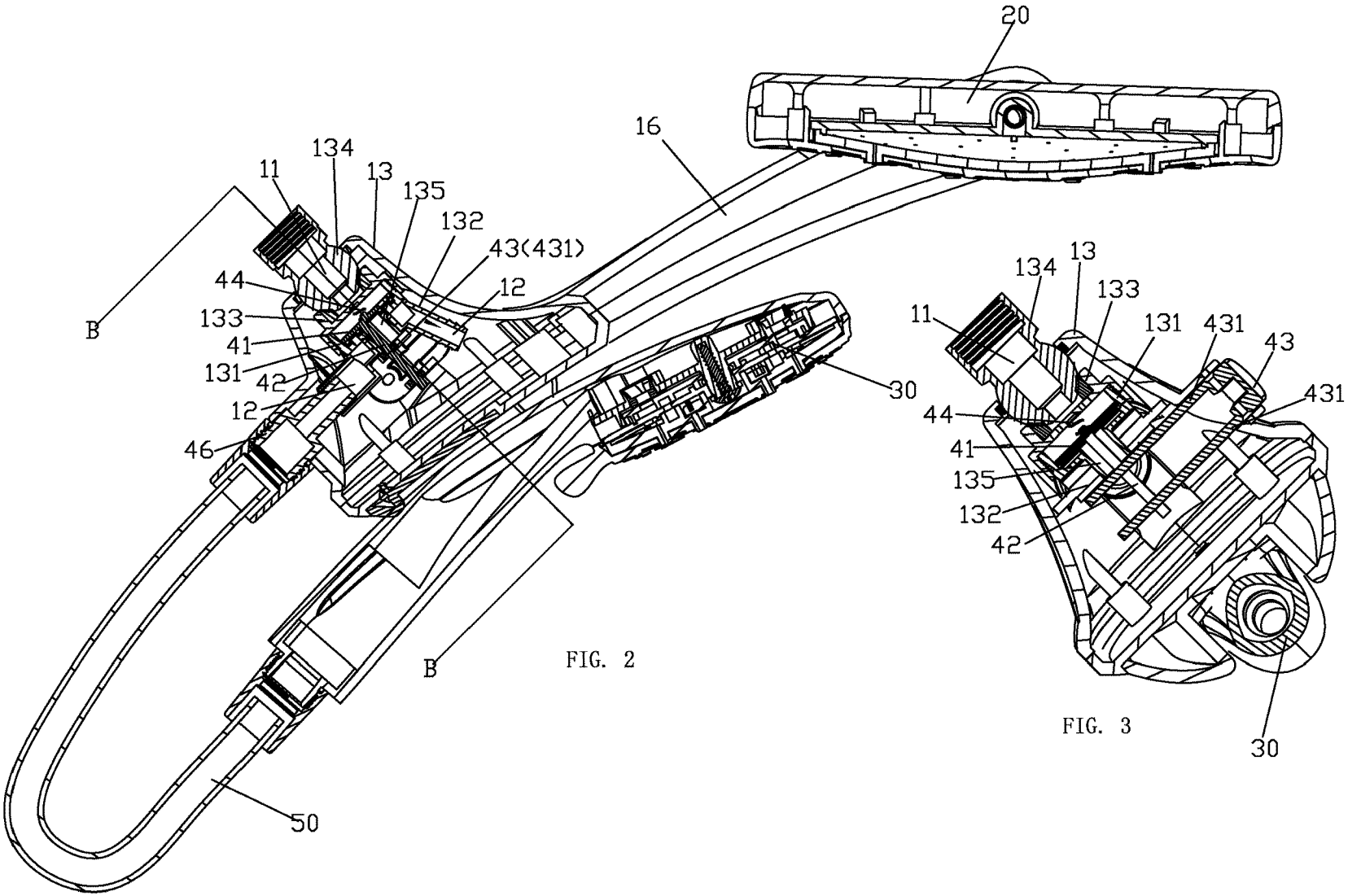
FIG. 2 illustrates a cross-section schematic diagram of the combination showerhead of a preferred embodiment under condition that water flows from the first showerhead.
FIG. 3 illustrates a B-B cross-section schematic diagram of the combination showerhead of FIG. 2.
Figure 4:
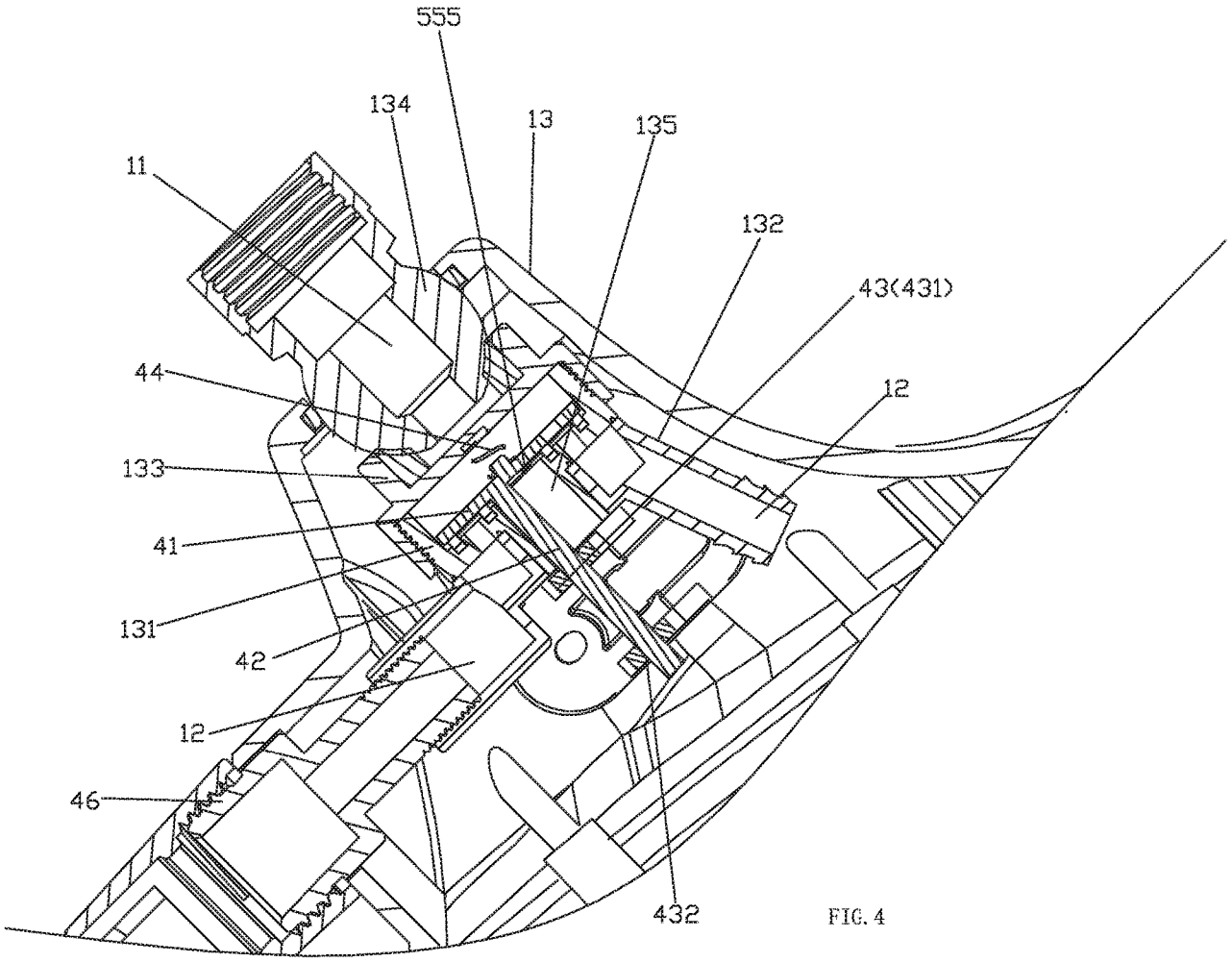
FIG. 4 illustrates a local enlarged schematic diagram of the combination showerhead of FIG. 2.
Figure 5:
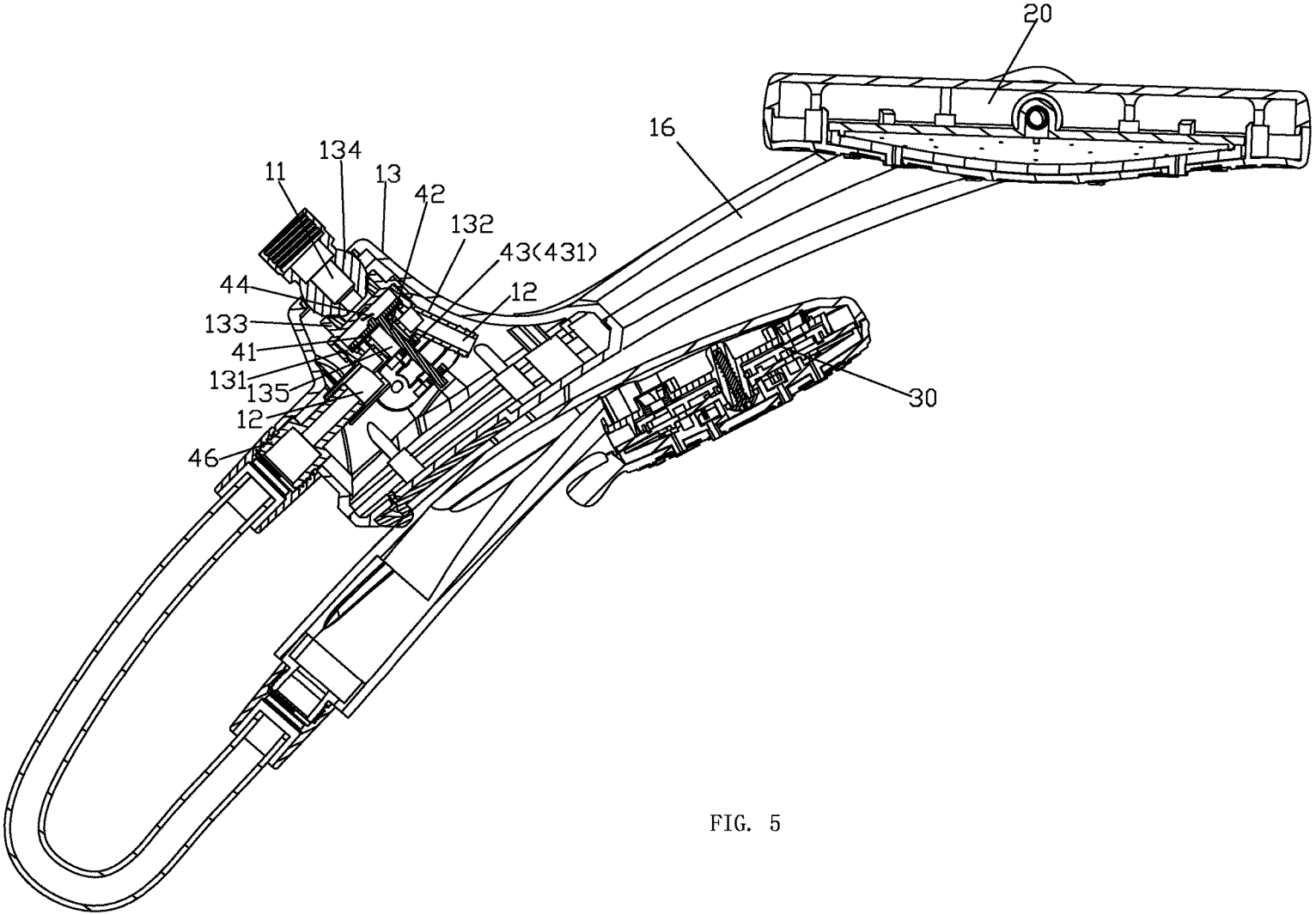
FIG. 5 illustrates a cross-section schematic diagram of the combination showerhead of a preferred embodiment under condition that water flows from the second showerhead.
Figure 6:
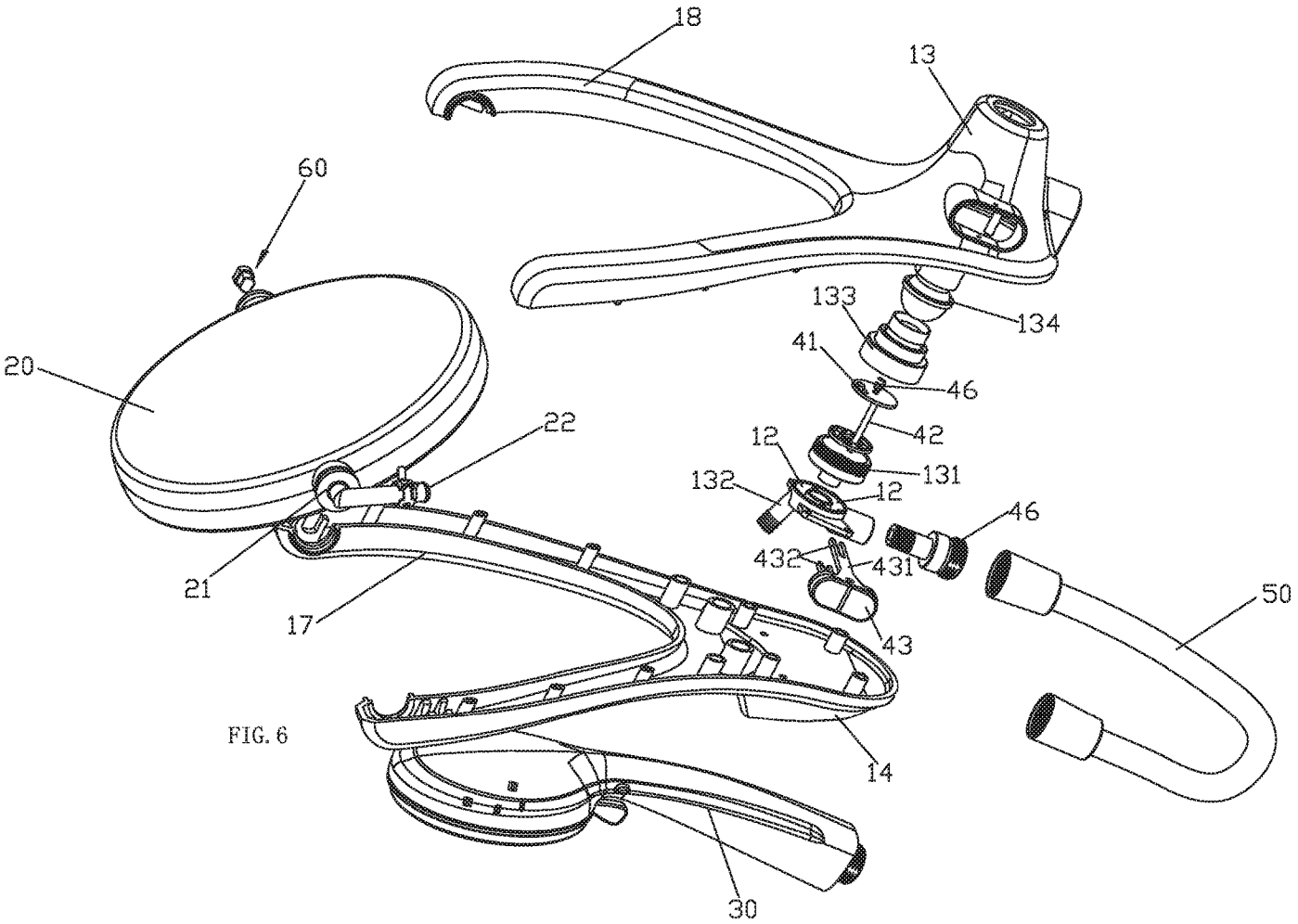
FIG. 6 illustrates an exploded perspective schematic diagram of the combination showerhead of a preferred embodiment.
Figure 8:
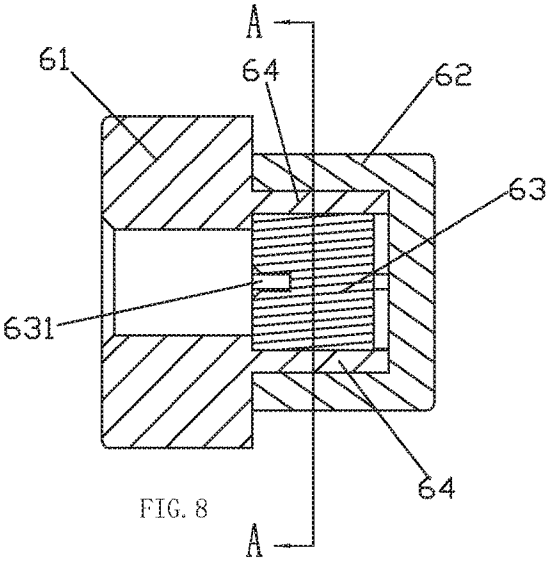
FIG. 8 illustrates a cross-section schematic diagram of the damping mechanism of a preferred embodiment.
Figure 7:
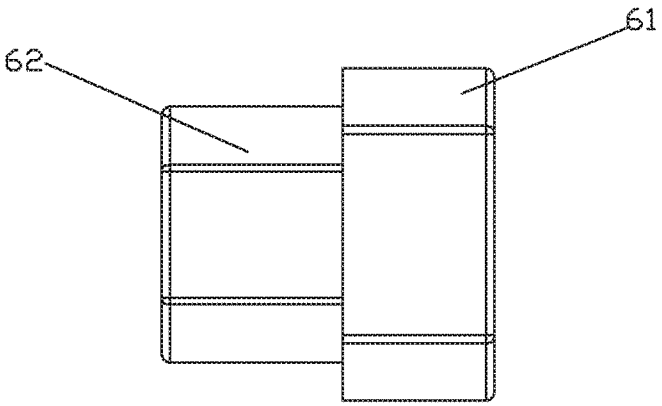
FIG. 7 illustrates a front view of the damping mechanism of a preferred embodiment.
Figure 9:
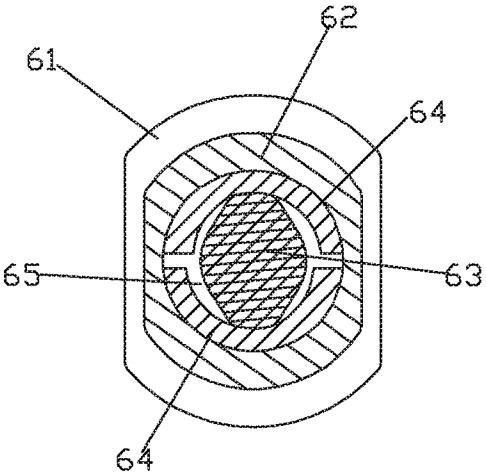
FIG. 9 illustrates an A-A cross-section schematic diagram of the damping mechanism of FIG. 8.

Combination showerhead with swing button switching refers to FIG. 1 to FIG. 9 comprises fixing holder 10, first showerhead 20, second showerhead 30 and switching mechanism 40. Fixing holder 10 could be mounted to supporting arm which could be water supply pipe fixed on the wall and the connection could be permanent connection or universal connection coordinate with spherical structure. The first showerhead 20 could be top spray showerhead or head showerhead mounted to fixing holder 10. The first showerhead 10 could have one or more function for different water spray types. Fixing holder 10 comprises inlet passage 11 connected to supporting arm and at least two diversion passages 12.

One diversion passage 12 is connected to second showerhead 30;

Others are connected to first showerhead 20, wherein:

If the first showerhead 20 has one water spray function, the amount of diversion passages 12 is 2.

If the first showerhead 20 has more than one water spray function, the amount of other diversion passages 12 could be 1, and the switching of first showerhead and second showerhead is realized by switching mechanism 40 while switching of water spray function on the first showerhead 20 is realized by another switching mechanism which is additional; or the amount of other diversion passages 12 could be equal to the amount of function with one to one connection, and switching mechanism 40 is capable of switching the second showerhead 30 and functions of the first showerhead 20.

Fixing holder 10 has a common portion 15 and two forking portion 16 forking extend from common portion 15, and back of common portion 15 is convexly disposed with assembly portion 13. In this embodiment, fixing holder 10 comprises front cover 17 and back cover 18, first cover 17 and back cover 18 are fixed and connected to form common portion and forking portion described above. Through hole is disposed on back cover corresponding to common portion and the edge of through hole extends backwards to form assembly portion 13.

Switching mechanism 40 is mounted in assembly portion 13 for switching any of the water diversion passages to connect to the inlet passage so as to realize switching of each water diversion passage, or, switching of the water diversion passages and close up of all of the water diversion passages. Switching mechanism 40 comprises diversion plate 41, eccentric component, i.e., rod 42, swing button 43 and elastomer 44. Diversion plate 41 is rotatably connected to fixing holder 10 and cooperates with inlet passage 11 and water diversion passages 12 for switching waterways. For example, the diversion plate 41 could have a through hole and, with alignment or separation of the through hole and the water diversion passages, to realize water connection or disconnection, or, the diversion plate could be fan-shaped and cover the diversion hole of the water diversion passage 12 completely or incompletely to realize water connection or disconnection. Eccentric component, i.e., rod 42 is fixed on a surface of diversion plate 41 facing to fitting surface of fixing holder 10. Swing button 43 is capable of swinging relative to fixing holder 10 and being connected to eccentric component, i.e., rod 42 in a transmission way and swinging of swing button 43 drives diversion plate 41 to rotate through transmission of movement of the eccentric component, i.e., rod 42 and the swing button 43.

Specifically, the assembly portion is disposed with through hole; connecting plate 431 is fixed on back of swing button 43 passing through the through hole from outside to inside. Swing button 43 is rotatably connected to assembly portion with at least part locates outside for user's operation, and swinging axis of swing button 43 is parallel to rotation axis of diversion plate 41. End of connecting plate 431 is concavely disposed with slide groove 432; eccentric component is connected in the slide groove 432 and capable of moving along slide groove 432. With cooperation of slide groove 432 and eccentric component 42, swinging of swing button 43 drives eccentric component to rotate relative to rotation axis of diversion plate and thereby drives diversion plate 41 to rotate. Eccentric component 42 could be column, and width of slide groove fits diameter of column. Two connecting plate could be disposed along swinging axis separately according to needs in order to improve transmission stability and slide grooves 432 are disposed on connecting plate. Elastomer 44 abuts against between diversion plate 41 and fixing holder 10 so that front surface of diversion plate 41 closely contacts fitting surface of fixing holder, and waterway switching is realized by relative rotation between diversion plate 41 and fitting surface of fixing holder. Fitting surface of fixing holder is disposed with diversion holes corresponding to diversion passages 12, wherein one group of diversion holes corresponds to a diversion passage and each group could include one or more than one holes. Diversion holes are switched with rotation of diversion plate and thereby switching of diversion passages is realized. There could be gasket disposed on fixing holder according to needs and gasket is disposed with through holes one to one corresponding to diversion holes, in this case, gasket forms the fitting surface.

In this embodiment, the fixing holder further comprises diversion body part which has fitting surface described above; an assembly hole is disposed throughout the upside and downside of the diversion body part, eccentric component 42 pass through the assembly hole and the slide groove of swing button 43 is connected on the part of eccentric component 42 passing through the assembly hole in transmission way. Fixing holder further comprises connecting seat 133 and the diversion body part comprises fixing seat 131 and diversion body 132. Diversion cavity is formed between connecting seat 133 and diversion body part, more specifically, diversion cavity is formed between connecting seat 133 and fixing seat 131 which forms part of inlet passage 11. Diversion plate 41 is movably connected on fixing seat 131; elastomer 44, such as spring, is configured between diversion plate and connecting seat 133 so that diversion plate 41 abuts against the fitting surface of fixing seat 131 in seal. Fixing seat 131 is disposed with at least two diversion holes to form part of diversion passages 12 respectively, and with rotating of diversion plate, different diversion holes connecting to diversion cavity is realized, so that switching of different diversion passages connecting to inlet passage 11 is realized. Diversion body 132 comprises at least two water passages which connecting to diversion holes respectively and form part of diversion passages 12. Fixing seat 131 is disposed with first through-hole, diversion body 132 is disposed with second through-hole, first through-hole and second through-hole align to form assembly hole 135. Connecting seat 133 is mounted to supporting arm via ball joint 134.

The first showerhead 20 is rotatably connected between two forking portion 16. A hose piece 21 disposed along the rotation axis of the first showerhead 20 is connected to the first showerhead 20 and a tube 22 is disposed on the other end. The hose piece 21 and tube 22 forms L-shape, and other diversion passages 12 are disposed along hose piece 21 and tube 22 to connect to the first showerhead. If there is only one diversion passage 12, then hose piece 21 and tube 22 could be part of diversion passage.

A damping mechanism 60 is disposed between forking portion 16 of fixing holder 10 and the first showerhead 20, which comprises locating holder 61, turning block 62 and cam 63. Locating holder 61 comprises a base and two dangling pieces 64 disposed separately in circumferential direction of locating holder 61 which forms a rotary sleeve-like structure as lancing forms between two dangling pieces 64. Outer wall of rotary sleeve-like structure is rotative surface, while inner wall is radii changing and forms radii changing part, cam 63 is disposed in the rotary sleeve to match the radii changing part; turning block 62 is sleeved on the rotary sleeve, friction force of dangling pieces 64 and turning block 62 changes with rotation of the cam 63 relative to the radii changing part and thereby the damping changes. In a preferred situation, the base is perforative so that one end surface of cam 63 is exposed and disposed with matching groove 631 for driving cam to rotate by users. Locating holder 61 and turning block 62 are connecting on components with relative rotation respectively, such as forking portion and the first showerhead.

In one embodiment, the second showerhead 30 is handle showerhead. Front lower part of common portion 15 is disposed with a connecting portion 14 for handle showerhead positioning. Connecting portion could, but not limited, be a plug base or magnetic structure. The diversion passage 12 connected to the second showerhead 30 further comprises a connector 46 to connect one water passage of the diversion body, and end opening of connector 46 forms water outlet. The connector could pass through assembly portion 13, and the handle showerhead is connected to outlet of corresponding diversion passage 12 via a hose 50.

Figure 10:
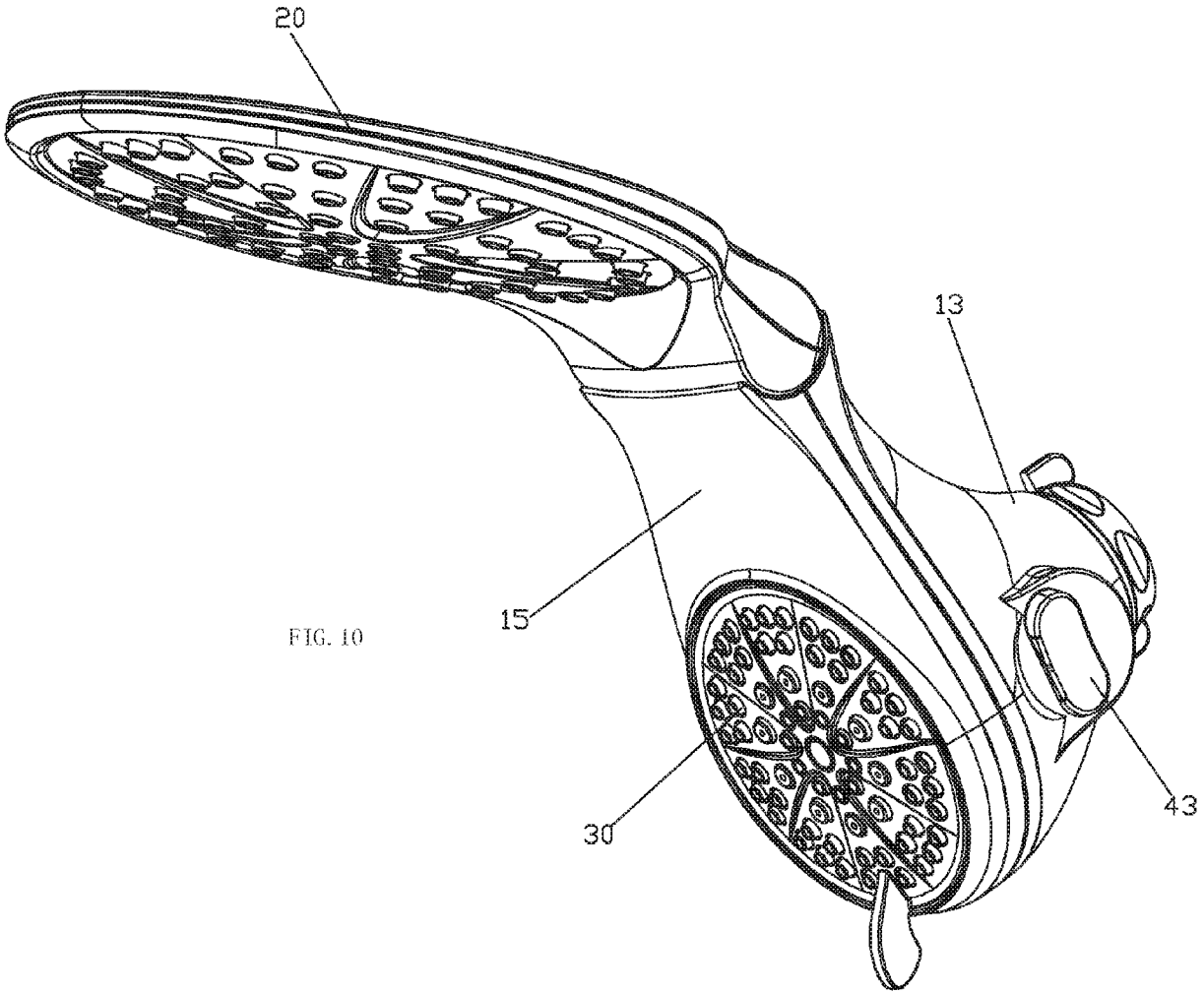
FIG. 10 illustrates a perspective schematic diagram of the combination showerhead of another preferred embodiment.
Figure 11:
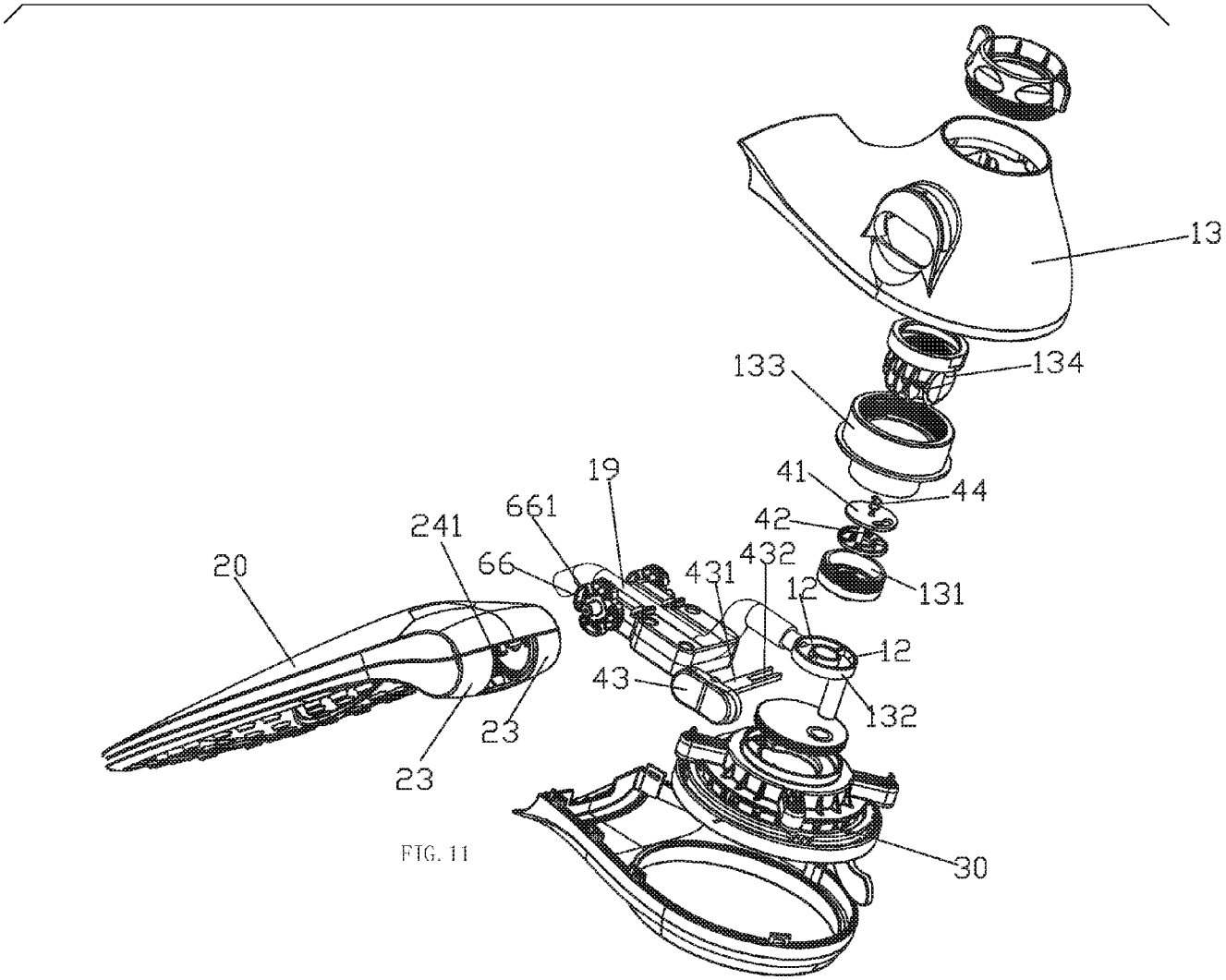
FIG. 11 illustrates an exploded perspective schematic diagram of the combination showerhead of another preferred embodiment.
Figure 12:
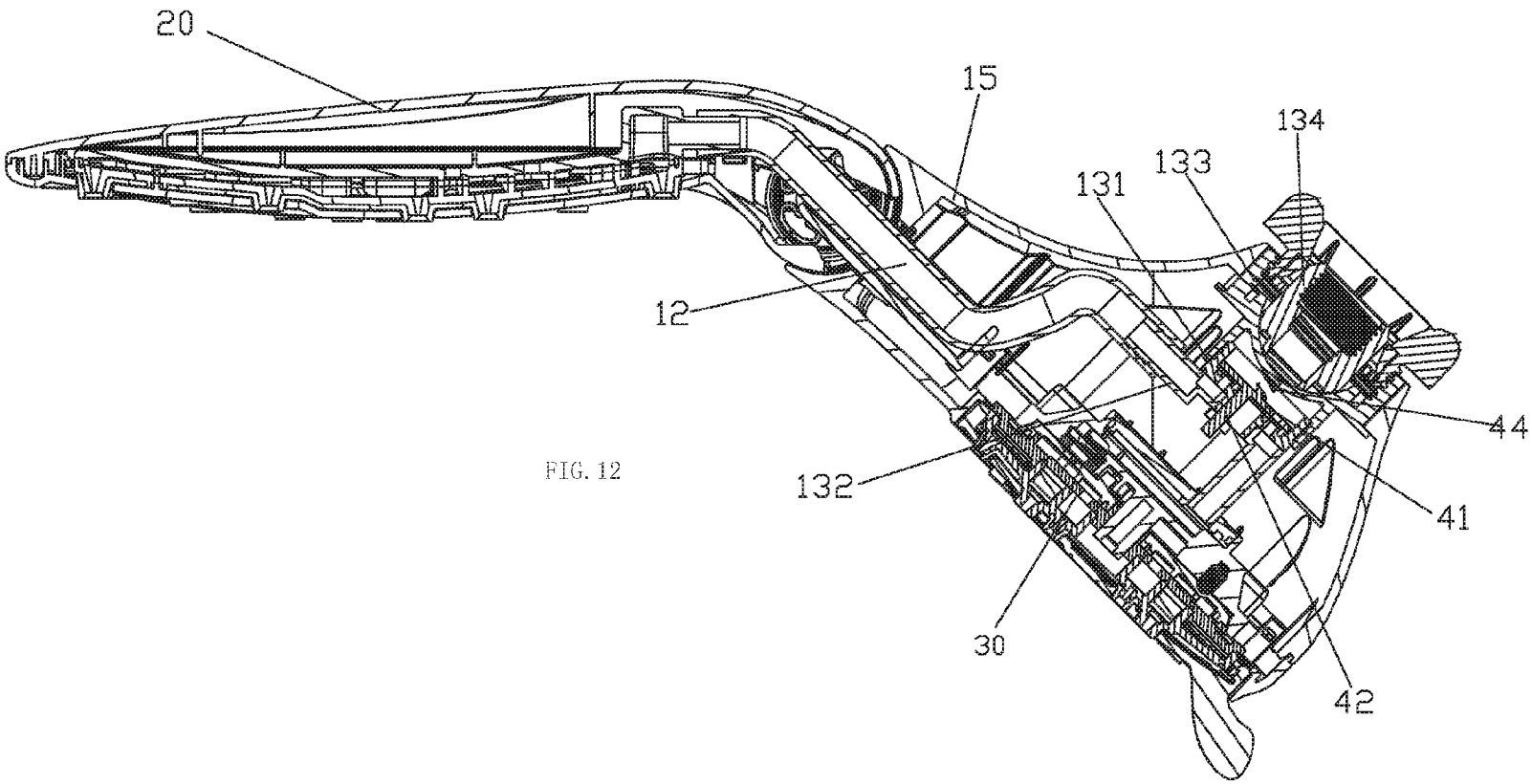
FIG. 12 illustrates a cross-section schematic diagram of the combination showerhead of another preferred embodiment.

In another preferred embodiment as shown in FIG. 10 to FIG. 12, the different comparing to above embodiment is that: the second showerhead 30 is fixed showerhead fixed on the front lower part of the common portion of fixing holder 10, and water passage of the diversion body connects to fixed showerhead directly. The common portion is convexly disposed with a convex part 19, and the first showerhead is convexly disposed with two convex lugs 23. Convex part 19 is configured between two convex lugs and the first showerhead is connected to convex part via pivot. The pivot is hollow for the other diversion passages passing through to connect to the first showerhead. The damping mechanism is configured between the convex part and the convex lugs, which comprises a connecting part 66 disposed on convex part 19. There could be one connecting part 66 having cylindrical surface, or more than one connecting parts 66 arrange in circumferential direction separately with each one has cylindrical surface. The cylindrical surface is convexly disposed with damping teeth 661. Convex lug 23 is concavely disposed with groove 24 which sleeve-connecting to the connecting part. Inner wall of groove 24 is also convexly disposed with damping teeth 221 separately mating damping teeth 661 to realize damping.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A combination showerhead with swing button switching of waterways, comprising:

a fixing holder that is mounted to a supporting arm and that comprises an inlet passage connected to the supporting arm, at least two water diversion passages, and a fixing seat and a connecting seat that define therebetween a diversion cavity;

a first showerhead that is mounted to the fixing holder and to which at least one of the at least two water diversion passages is connected;

a second showerhead to which another of the at least two water diversion passages is connected;

a switching mechanism that comprises:

a water diversion plate that is disposed within the diversion cavity, that is rotatable relative to the fixing holder, and that cooperates with the inlet passage and the at least two diversion passages to switch waterways;

a rod having an end that is fixed on the water diversion plate; and a swing button that is swingable relative to the fixing holder and that is connected to the rod so that swinging of the swing button drives the rod and causes the water diversion plate to rotate to switch waterways, wherein the swing button has a back and a connecting plate is fixed on the back of the swing button, wherein the connecting seat has an end and an end of the connecting plate is disposed with a slide groove, and wherein the rod is connected with and movable along the slide groove so that the slide groove and the rod cooperate with swinging of the swing button to cause the water diversion plate to rotate.

2. The combination showerhead with swing button switching according to claim 1, wherein the switching mechanism further comprises an elastomeric portion that abuts against and between the water diversion plate and the fixing holder.

3. The combination showerhead with swing button switching according to claim 1, wherein the fixing holder comprises a diversion body which has a fitting surface that is concavely disposed and that has defined there through a plurality of diversion holes in one to one correspondence with the at least two water diversion passages;

wherein the water diversion plate sealingly abuts against the fitting surface to realize switching among the plurality of diversion holes by rotating; and wherein an assembly hole is defined through an upside and a downside of the diversion body, the rod is fixed on a surface of the water diversion plate facing toward the fitting surface, the rod passes through the assembly hole and the swing button is connected on a portion of the rod that passes through the assembly hole.

4. The combination showerhead with swing button switching according to claim 1, wherein the fixing holder has a back and the back of the fixing holder is convexly disposed with an assembly portion and the switching mechanism is disposed inside the assembly portion with at least a portion of the swing button being located outside of the assembly portion for operation by a user.

5. The combination showerhead with swing button switching according to claim 4, wherein the second showerhead has a handle and is a handle showerhead, wherein an outlet of the at least two water diversion passages is connected to the second showerhead and is disposed on a sidewall of the assembly portion, and wherein the handle showerhead is connected to a corresponding outlet through a flexible hose with the fixing holder being disposed with a connecting portion on a front lower portion thereof for handle showerhead connection.

6. The combination showerhead with swing button switching according to claim 4, wherein the second showerhead is a fixed showerhead that is fixed on the fixing holder on a front lower portion thereof.

7. The combination showerhead with swing button switching according to claim 4, wherein the fixing holder has a common portion and two forking portions that extend from the common portion, wherein the first showerhead is rotatably connected between the two forking portions, and wherein the first showerhead has a rotation axis and a hose piece is disposed along the rotation axis of the first showerhead and a part of the at least two water diversion passages is connected to the first showerhead along the hose piece.

8. The combination showerhead with swing button switching according to claim 7, wherein the assembly portion is disposed on a back of the common portion.

9. The combination showerhead with swing button switching according to claim 4, wherein the first showerhead is rotatably connected to the fixing holder, and a damping mechanism is disposed between the fixing holder and the first showerhead.

10. The combination showerhead with swing button switching according to claim 9, wherein the damping mechanism comprises a locating holder from which extend at least two dangling portions, a turning block having a cylindrical inner wall that surrounding the at least two dangling portions and within which the at least two dangling portions are separately circumferentially disposed and a cam disposed within the at least two dangling portions, at least two dangling portions each have an inner wall having a variable radius and cooperate to form a rotary sleeve structure within which the cam is disposed, and the turning block is sleeved on the rotary sleeve structure, and wherein the at least two dangling portions and the turning block have a frictional force therebetween that changes with rotation of the cam relative to the variable radius of respective inner walls of the at least two dangling portions to vary damping by the damping mechanism.

11. The combination showerhead with swing button switching according to claim 4, wherein the fixing holder has a common portion and the first showerhead is rotatably connected to the common portion, and wherein the first showerhead has a rotation axis and at least a hose piece is disposed along the rotation axis of the first showerhead, and a part of the at least two water diversion passages is connected to the first showerhead along the hose piece.

* * * * *